US006129473A

United States Patent [19]

Shu

[11] Patent Number: 6,129,473

[45] Date of Patent: Oct. 10, 2000

[54] PEN OR THE LIKE WITH DUAL ILLUMINATING ENDS

[76] Inventor: Ming-Tay Shu, P.O. Box 82-144, Taipei, Taiwan

[21] Appl. No.: 09/484,597

[22] Filed: Jan. 18, 2000

[51] Int. Cl.[7] ..... B43K 29/00

[52] U.S. Cl. ..... 401/195; 401/52; 362/118

[58] Field of Search ..... 401/195, 52, 192; 362/118

[56] References Cited

U.S. PATENT DOCUMENTS

| | | | |
|---|---|---|---|
| 5,413,429 | 5/1995 | Shiau | 401/195 |
| 5,446,633 | 8/1995 | Hanggi | 401/195 |
| 5,735,592 | 4/1998 | Shu | 401/195 |
| 5,803,583 | 9/1998 | Hsieh | 401/195 |

*Primary Examiner*—David J. Walczak
*Attorney, Agent, or Firm*—A & J

[57] ABSTRACT

A pen or the like with dual illuminating ends includes a light transmitting case, a protective seat connected to the top end of the light transmitting case, a top illuminating module mounted within the protective seat, a light transmitting moveable seat mounted at the bottom of the protective seat, a bottom illuminating module mounted within the light transmitting moveable seat, a refill mounted within the light transmitting case and urged against the moveable seat, both the structures of the top and bottom illuminating module are similar and are mounted asymmetrically. The top and bottom illuminating module includes light emitting diode, a light emitting seat, a battery, a battery seat, a metallic spring, and a metallic blocking nut to form circuit in parallel. When the refill exerts a force, a reaction causes the refill to move upward to push the moveable seat such that the blocking nut of the two illuminating modules touches the battery to form a closed circuit, which causes the two illuminating modules to glow, and the glow at the bottom end is refracted via the teeth-like or wavelike multiple bend surfaces of the inner wall of the light emitting case. The focusing light and refraction of light effect provide the entire pen to illuminate.

7 Claims, 7 Drawing Sheets

PEN OR THE LIKE WITH DUAL ILLUMINATING ENDS

BACKGROUND OF THE INVENTION a) Technical Field of the Invention

The present invention relates to a pen or the like with dual illuminating ends, which provides funs for children while using the pen or the like in writing.

b) Description of the Prior Art

The applicant, Ming-Tay Hsu, of the present application has lodged an application entitled "An illuminating Ball-point Pen" with the USPTO and a patent has been allowed. In this granted patent, only the top end of the ball-point pen can provide illumination but the ball-point pen casing does not. If the top end and the casing illuminate with light, then it will provide funs while writing. Particularly, the children will be attracted to use the pen or the like to write or scribble.

SUMMARY OF THE INVENTION

The present invention relates to a pen or the like with dual illuminating ends, which provides funs for children while using the pen or the like in writing.

Accordingly, it is an object of the present invention to provide a pen or the like with dual illuminating ends comprising a light transmitting case, a protective seat connected to the top end of the light transmitting case, a top illuminating module mounted within the protective seat, a light transmitting moveable seat mounted at the bottom of the protective seat, a bottom illuminating module mounted within the light transmitting moveable seat, a refill mounted within the light transmitting case and urged against the moveable seat, wherein both the structures of the top and bottom illuminating module are similar and are mounted asymmetrically, and the top and bottom illuminating modules individually include a light emitting diode, a light emitting seat, batteries, a battery seat, a metallic spring, and a metallic blocking nut Another object of the present invention is to provide a pen or the like with dual illuminating ends, wherein one contact leg of the light emitting diode is in contact with the electrode of the battery and the other contact key is in contact with the spring having one end contacting with the metallic blocking nut. When the refill is pushed upward, the light transmitting seat is also pushed upward to urge the protrusions located at the two metallic blocking nuts to contact with the other electrode of the battery, by means of the spring, current is conducted to the light emitting diode to illuminate. Light from the light emitting protective cover at the top and bottom end of the pen, and the moveable seat is refracted to illuminate.

Yet another object of the present invention is to provide a pen or the like with dual illuminating ends, wherein the illuminated light from the bottom section of the pen is refracted to the teeth-like or wavelike multiple bend surface of the inner wall of the pen case to form a focused light or refraction light effect so as to produce an illumination from the pen.

Another object of the present invention is to provide a pen or the like with dual illuminating ends, wherein when the refill is pressed while writing, an illumination is automatically formed.

DETAILED DESCRIPTION OF THE PREFERRED EMBODIMENT

Figure 1:
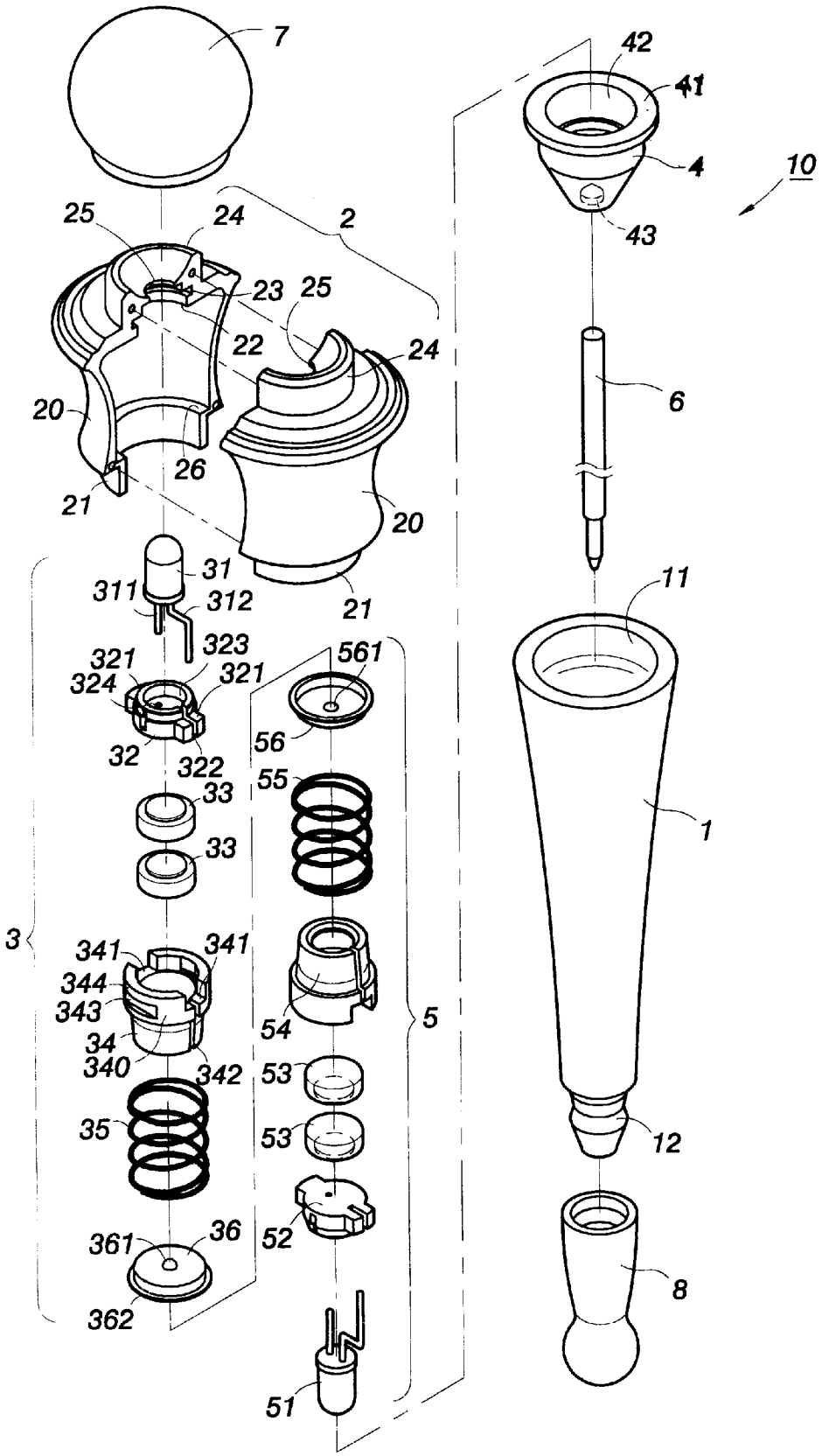
FIG. 1 is a perspective exploded view of a pen or the like with dual illuminating ends in accordance with the present invention.
Figure 2:
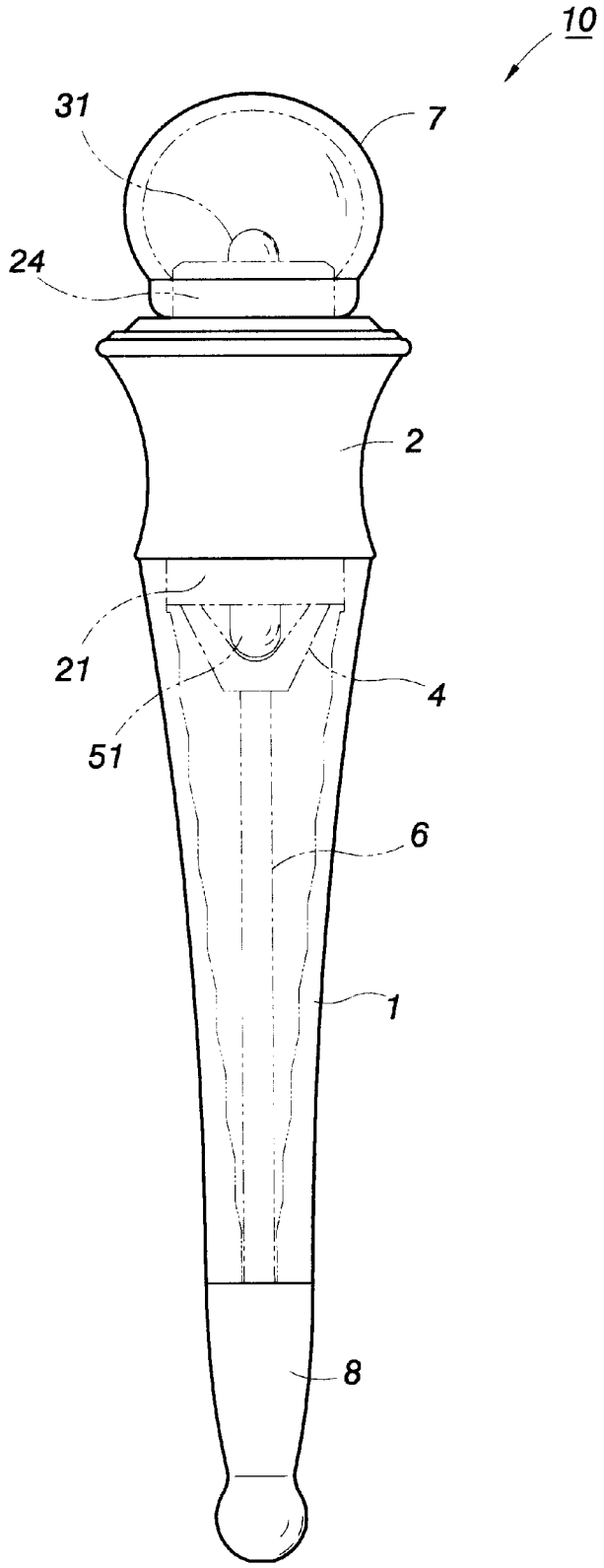
FIG. 2 is a schematic front elevational view of a pen or the like with dual illuminating ends in accordance with the present invention.

FIGS. 1 is a perspective exploded view of a pen or the like with dual illuminating end. As shown in the figure, the pen 10 comprises a light transmitting case 1, a protective seat 2, a top illuminating module 3, a light transmitting moveable seat 4, a bottom illuminating module 5, a refill 6, a light transmitting protective cover 7, and a pen cap 8. The perspective view of the pen is shown in FIG. 2. The structure of the top illuminating module 3 and that of the bottom illuminating module 5 are similar but are mounted asymmetrically to form parallel circuits. The top and bottom illuminating modules 3, 5 are individually provided with a light emitting diode 31, 51, a light emitting seat 32, 52, two batteries 33, 53, a battery seat 34, 54, metallic springs 35, 55 and a metallic blocking nut 36, 56.

Figure 3:
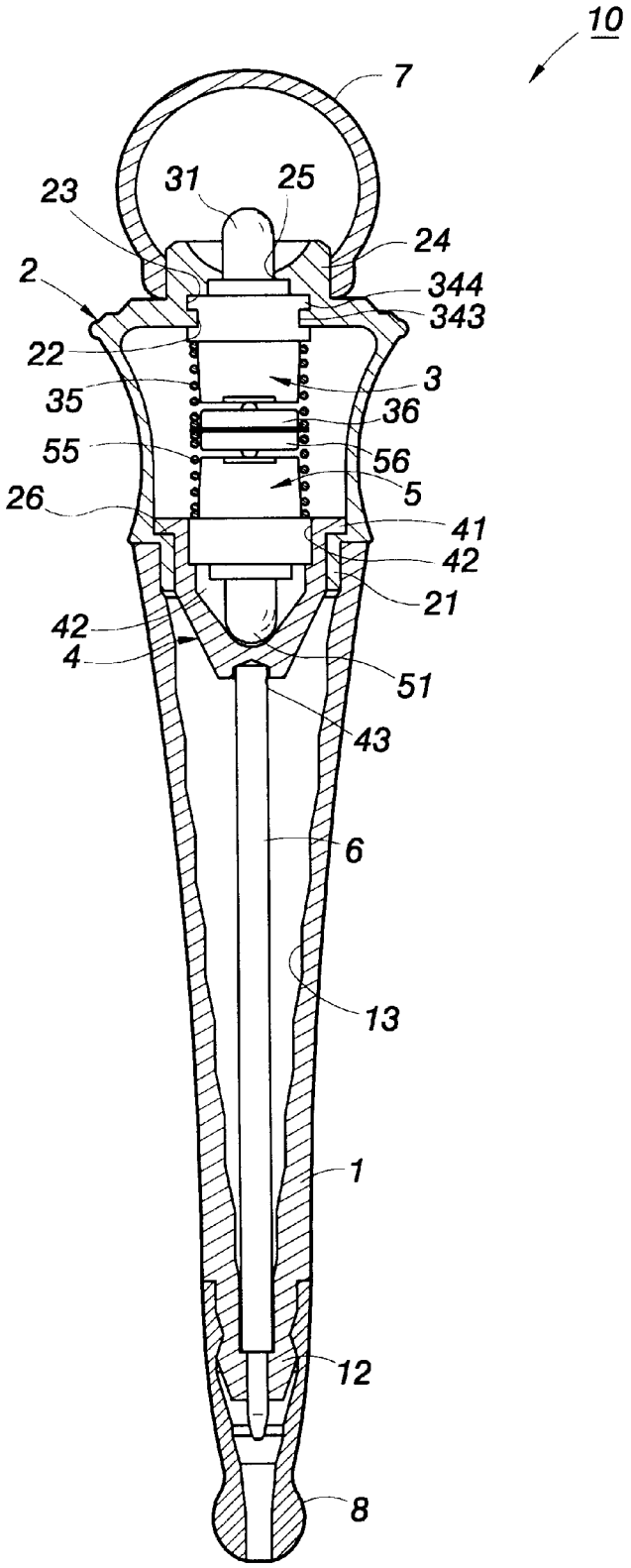
FIG. 3 is a sectional view of a pen or the like with dual illuminating ends in accordance with the present invention.

Referring to FIGS. 1 and 3, the light transmitting pen case 1 is a trumpet-shaped casing having a top end provided with an opening 11 for the mounting of the protective seat 2. The bottom end of the case 1 is a conic tube 12 to engage with the pen cap 8. A refill 6 is provided within the pen case 1, and the shape of the inner wall of the case 1 is teeth-like or wavelike shaped multiple bend surfaces. These surfaces provide light focusing effect and light refraction effect.

In accordance with the present invention, the protective seat 2 comprises two semi-protective cover bodies 20, symmetrically mounted to each other. The bottom end of the protective seat 2 is provided with a protruded tube 21 which can be engaged with the opening 11 of the case 1 for mounting. A protruded post 24 at the top end can be engaged with the light transmitting protective cover 7. The shape of the protective cover 7 can be various shapes, such as, shapes of animals or shapes of cartoons, etc. It is a hollow space within the protective seat 2 which can accommodate the top illuminating module 3, the bottom illuminating module 5 and the light transmitting moveable seat 4. The top section of the protective seat 2 is provided with a recess 23 and a protruded ring 22. The recess 23 can receive the protruded block 344 at the upper edge of the battery seat 34 of the top illuminating module 3. The protruded ring 22 can be engaged with the groove 343 of the battery seat 34 so that the battery seat 34 can be fixed at the protective seat 2.

The protruded post 24 within the protective seat 2 is provided with a small hole 25 for the insertion of the light emitting diode 31. The battery seat 54 of the bottom illuminating module 5 is inversely inserted at the hollow illuminating slot 42, and the moveable seat 4 can be mounted at the bottom section of the protective seat 2. The protruded ring 41 at the lateral side of the seat 4 is blocked by the protruded stage 26 so that it will not be dislocated. The bottom section of the seat 4 is exposed outside the protruded tube 21 and the bottom end of the seat 4 is provided with a positioning slot 43 for the insertion and positioning of the refill 6.

Figure 4:
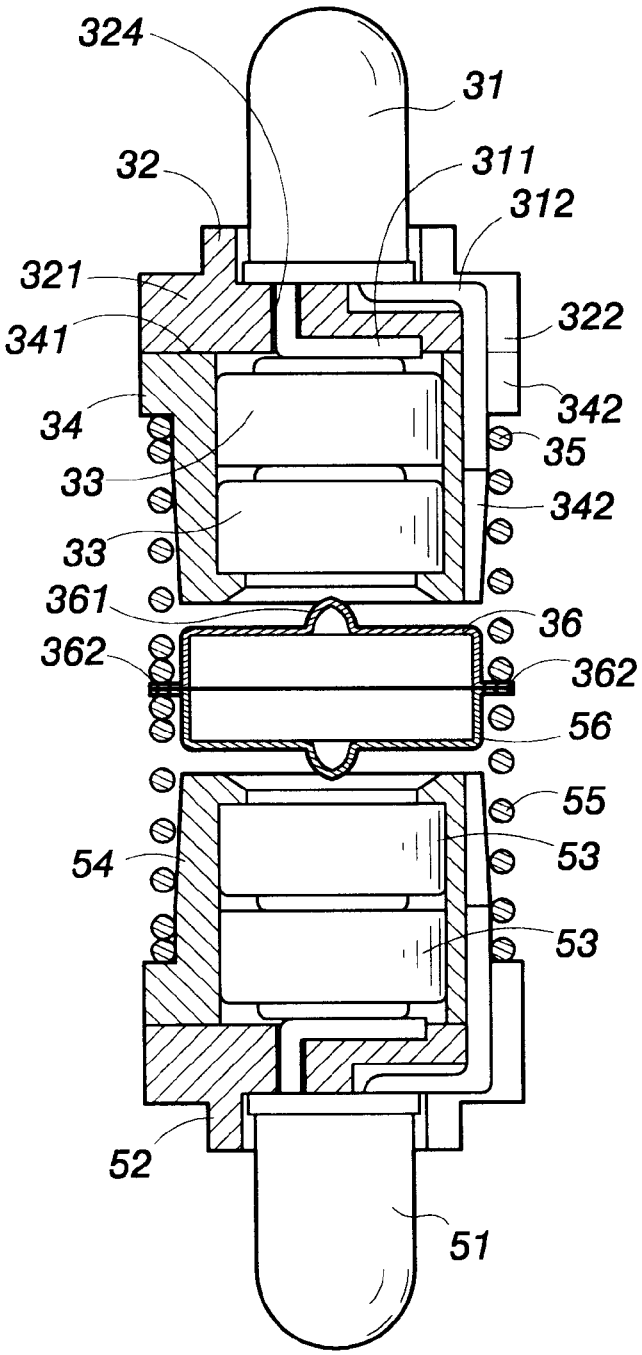
FIG. 4 is a sectional view of the top illuminating module and the bottom illuminating module in accordance with the present invention.

Referring to FIG. 4, there is shown a sectional view of the top illuminating module 3 and the bottom illuminating module 5. The bottom of the battery seat 34 at the top illuminating module 3 is provided with a metallic blocking nut 36, and a spring 35 is provided in between the metallic blocking nut 36 and the battery seat 34. The top end of the spring 35 is restricted by the top slot 340 of the battery seat 34, and the bottom end of the spring 35 is restricted by the blocking ring 362 of the metallic blocking nut 36. The extension of the spring 35 causes the battery 33 not to contact with the protrusion 361 of the metallic blocking nut 36 under normal condition. The two sides of the top slot 340 of the battery seat 34 are individually provided with a slot 341, and one of the slot 341 is provided with a vertical notch 342 extended to the bottom section of the battery seat 34.

The two side terminals of the light emitting seat 32 are provided with a protruded block 321 which can be engaged with the slot 341 of the battery seat 34. The protruded block 321 is provided with a notch 322 which is corresponding to the vertical notch 342. On the top section of the light emitting seat 32, a top slot 323 is provided, and an insertion hole 324 is located within the slot 323. The insertion hole 324 allows the insertion of one of the metallic leg 311 of the light emitting diode 31 and to contact with the electrode of the battery 33 on the battery seat 34. The other leg 312 of the light emitting diode 31 is located across the notch 322 of the illuminating seat 32 and then extended downward to enter the vertical notch 342 of the battery seat 34 to touch spring 35.

In accordance with the present invention, the bottom illuminating module 5 and the top illuminating module 3 are mounted asymmetrically such that the metallic blocking nuts 36, 56 are in contact with each other. As the structure of the bottom illuminating module 5 and that of the top illuminating module 3 are identical, further explanation of the bottom illuminating module 5 is not required.

Figure 5A:
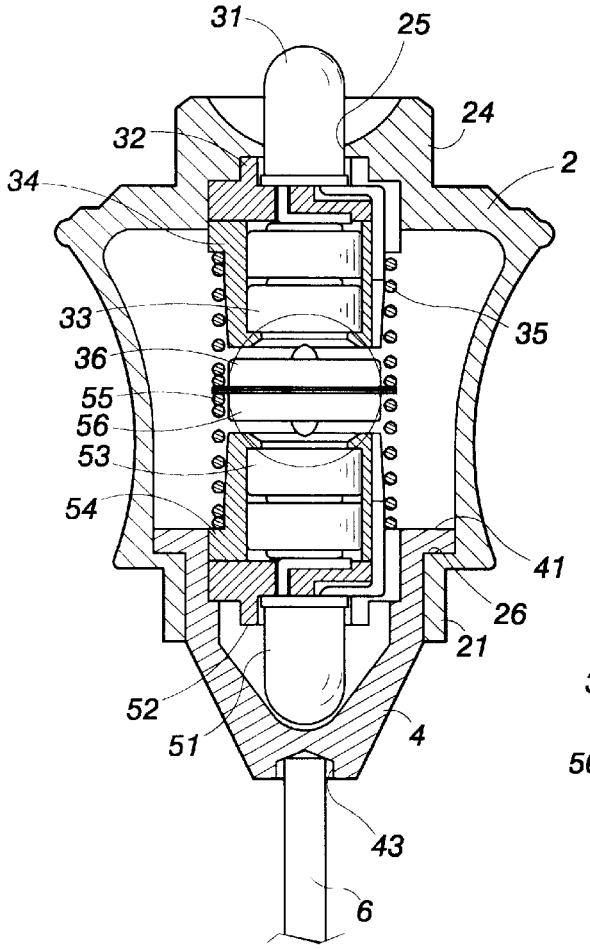
FIG. 5A is a sectional view of the pen or the like with dual illuminating ends prior to illumination.
Figure 5B:
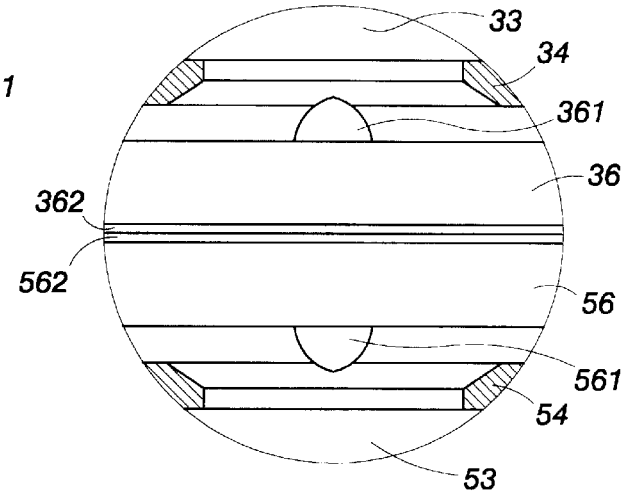
FIG. 5B is a schematic view showing the metallic blocking nut not touching the battery.

FIG. 5A shows the sectional view of the pen before an illumination is occurred. As shown in the figure, before the refill 6 is squeezed or pressed, the two springs 35, 55, cause the two metallic blocking nuts 36, 56 to separate from the batteries 33, 53 and the protrusions 361, 561 of the two metallic blocking nuts 36, 56 do not contact with the electrode of the batteries 33, 53, which is shown in FIG. 5B.

Figure 6A:
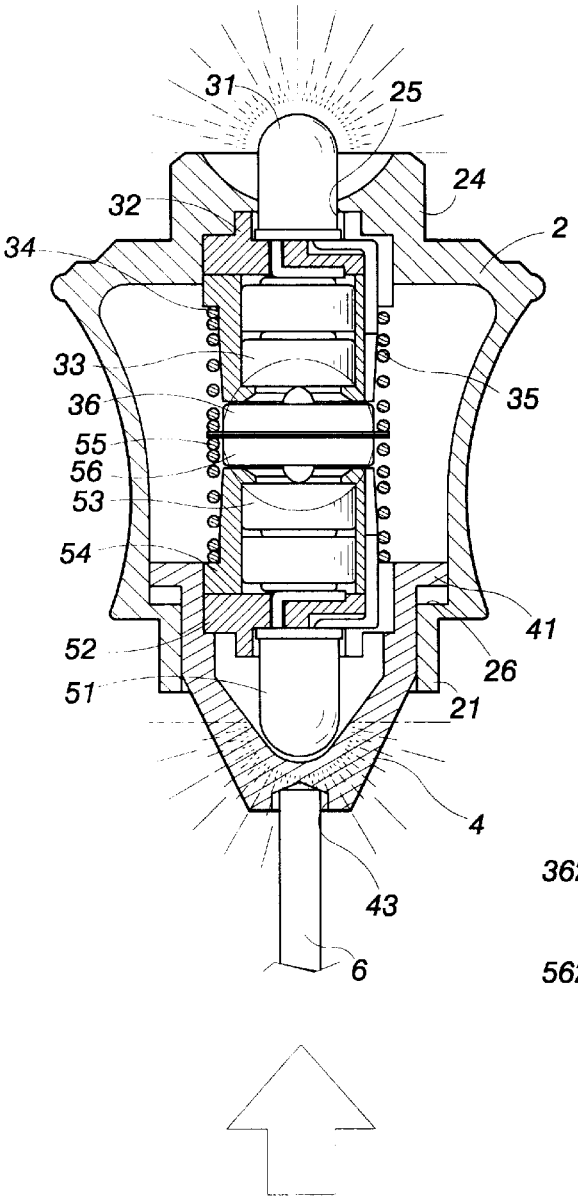
FIG. 6A is a sectional view of the pen or the like with dual illuminating ends in the process of illuminating.
Figure 6B:
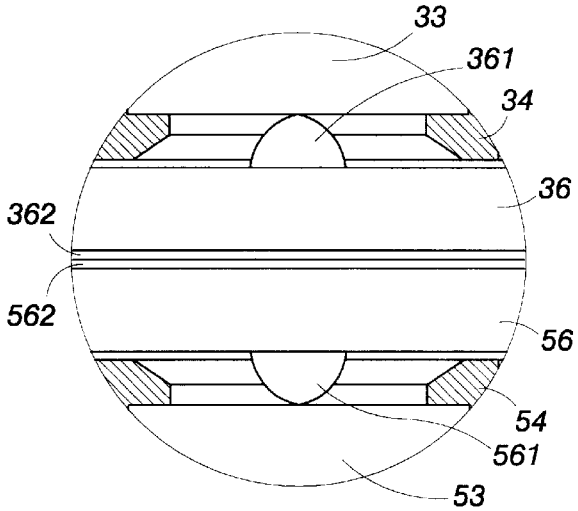
FIG. 6B is a schematic view showing the metallic blocking nut touching the battery
Figure 7:
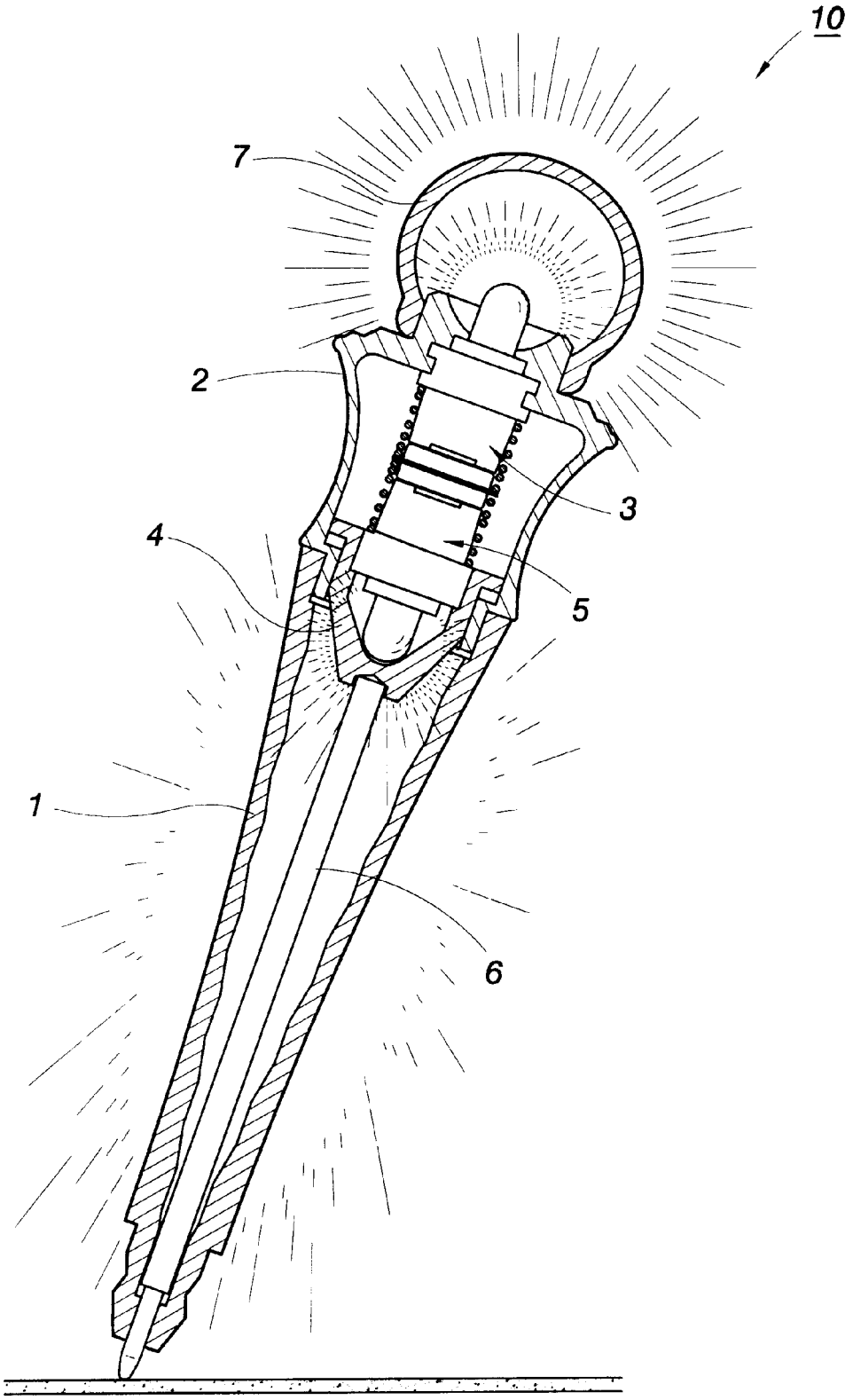
FIG. 7 is a sectional view showing the illuminating of a pen or the like with dual illuminating ends while writing.

FIG. 6A shows an illumination is occurred. As shown in the figure, when a force is exerted to the refill 6, the refill 6 moves upward to urge the moveable seat 4 to move upward so that the distance between the two illuminating modules 3, 5 is shortened and the protrusions 361, 351 of the metallic blocking nuts 36, 56 are in contact with the electrode of the batteries 33, 53, which is shown in FIG. 6B. The two light emitting diodes 31, 51 are lighted, and the protective cover 7 and the moveable seat 4 at the top and bottom section of th e pen 10 are refracted with light. The light refracted from the moveable seat 4 within the inner wall 13 of the case 1 causes the entire pen to glow with illumination, which is shown in FIG. 7.

When the refill 6 moves away from a writing surface, no force is exerted to the refill 6. At this instance, the springs 35, 55 at the illuminating modules 3, 5 restore to its extension position. Thus, it returns to the situation as shown in FIG. 5-1 and the light emitting diode 31, 51 stops illumination.

While the invention has been described with respect to a preferred embodiment, it will be clear to those skilled in the art that modifications and improvements may be made to the invention without departing from the spirit and scope of the invention. Therefore, the invention is not to be limited by the specific illustrative embodiment, but only by the scope of the appended claims.

I claim:

1. A writing implement with dual illuminating ends comprising: a light transmitting case, a protective seat connected to a top end of the light transmitting case, a top illuminating module mounted within the protective seat, a light transmitting moveable seat mounted at the bottom of the protective seat, a bottom illuminating module mounted within the light transmitting moveable seat and a refill mounted within the light transmitting case and urged against the moveable seat, characterized in that an interior of the protective seat is mounted with the top illuminating module and the bottom illuminating module and the light transmitting moveable seat, structures of the top and bottom illuminating module are similar and are mounted asymmetrically, the top illuminating module is fixed at a top section of the protective seat and the bottom illuminating module is mounted within the light transmitting moveable seat, the moveable seat is movingly mounted at the bottom section of the protective seat, the top and bottom illuminating modules each include a light emitting diode, a light emitting seat, batteries, a battery seat, a metallic spring, and a metallic blocking nut to form circuits in parallel wherein the light emitting diode is located within the light emitting seat, and the light emitting seat is mounted on a top of the battery seat, the batteries are located within the battery seat, and the metallic blocking nut is mounted at the bottom of the battery seat, and the metallic spring is mounted between the metallic nut and the batteries, thereby when the refill exerts a force, a reaction causes the refill to move upward to push the moveable seat such that the blocking nuts of the two illuminating modules touches the batteries to form a closed circuit, which causes the two illuminating modules to illuminate, light from the modules travels from the top end of the protective seat to the bottom end of the moveable seat, and the light from the bottom end is refracted via an inner wall of the light transmitting case to produce an illumination effect.

2. A writing implement with dual illuminating ends as set forth in claim , wherein the inner wall of the light transmitting case is teeth-like shape or wave-like shape with multiple bends surfaces.

3. A writing implement with dual illuminating ends as set forth in claim 1 or 2, wherein the shape of the light transmitting case is a trumpet-shaped casing.

4. A writing implement with dual illuminating ends as set forth in claim 1, wherein the two metallic blocking nuts are provided with protrusions, and the two blocking nuts are urged against each other.

5. A writing implement with dual illuminating ends as set forth in claim 1, wherein an interior of the top end of the protective seat is provided with a protruded ring and a recess to receive a protruded block at a top edge of the battery seat of the top light illuminating module, and the protruded ring is engaged with a groove of the battery seat so that the battery seat is fixed within the protective seat.

6. A writing implement with dual illuminating ends as set forth in claim 1, wherein a bottom section of an interior of the protective seat is provided with a protruded stage to block a protruded ring at a lateral edge of the moveable seat, the bottom section of the moveable seat is exposed outside a bottom end of the protective seat.

7. A writing implement with dual illuminating ends as set forth in claim 1, wherein the protective seat is engageably mounted with a light transmitting protective cover.

* * * * *